United States Patent [19]

Solomon et al.

[11] Patent Number: 4,890,983

[45] Date of Patent: Jan. 2, 1990

[54] ABOVE-GROUND STORAGE SYSTEM

[75] Inventors: Stuart G. Solomon; David C. Whitman, both of San Jose, Calif.

[73] Assignee: Pacific Environmental Industries, San Jose, Calif.

[21] Appl. No.: 233,314

[22] Filed: Aug. 17, 1988

[51] Int. Cl.[4] ..... F04B 49/04

[52] U.S. Cl. ..... 417/41; 417/46; 137/376; 137/565

[58] Field of Search ..... 137/264, 376, 565; 417/40, 41, 46, 63

[56] References Cited

U.S. PATENT DOCUMENTS

| | | | |
|---|---|---|---|
| 810,237 | 1/1906 | Wadsworth | 417/41 |
| 1,114,019 | 10/1914 | Morris | 417/41 |
| 1,273,195 | 7/1918 | Snyder | 417/41 |
| 1,625,765 | 4/1927 | Ratzenstein | 137/376 X |
| 2,772,834 | 12/1956 | Swenson et al. | 417/41 X |
| 2,864,527 | 12/1958 | Altman et al. | 137/376 X |
| 3,827,455 | 8/1974 | Lee | 137/264 X |
| 4,376,489 | 3/1983 | Clemens | 137/264 X |
| 4,815,621 | 3/1989 | Bartis | 220/1 B |

OTHER PUBLICATIONS

Cla-Val Co. (Newport Beach, Calif.), Advertising Brochure, Model CF1-C1 Float Control, date unknown.

Graco Inc. (Minneapolis, Minn.) Instructions-Parts List, Model 221-139, Series A, Double-Diaphragm Pump, 1987.

"Safe-T-Tank Corp.," Advertising Brochure (portions dated Mar. 1, 1989).

"Introducing the Agape Above Ground Waste oil Recovery System," (dated only by postmark, Jun. 7, 1989).

"Rely on Us for Liquid Storage," Reliance Tank (undated).

Facsimile from Doehrman Company, Inc., May 9, 1989.

*Primary Examiner*—John Rivell

*Attorney, Agent, or Firm*—Townsend and Townsend

[57] ABSTRACT

An above-ground storage system, especially for use with hazardous materials is disclosed. The system includes a first inner tank and a second outer tank. An air-operated diaphragm pump is used to fill the tank. In order to prevent overfilling of the tank and, therefore environmental contamination, a valve is installed in the air supply line to the air pump. The valve is operated by a float within the tank. When the float becomes submerged in liquid the valve is closed by an arm connected to the float.

10 Claims, 4 Drawing Sheets

ABOVE-GROUND STORAGE SYSTEM

BACKGROUND OF THE INVENTION

1. Field of the Invention

The present invention relates in general to the field of liquid storage systems. In particular, the present invention provides a greatly improved method and apparatus for storing waste oil products above the ground.

2. Description of Related Art

In recent years significant levels of concern have been raised over the use of below-ground liquid storage vessels such as tanks. Such vessels have in the past been used to store a wide variety of materials including gasoline, waste oil, and a myriad of other chemicals. Problems arise when the vessel begins to leak due to corrosion and the like and allows a stream of material to leak into the surrounding soil without detection over a long period of time. After entering the soil, these materials percolate downward into, for example, ground water supplies. This represents a clear environmental danger. Equipping underground vessels to be environmentally safe is extremely expensive. Monitoring and repair of underground vessels is also expensive and complex.

As a consequence, above-ground storage vessels are becoming more frequently used. By using an above-ground storage tank it is possible to more closely monitor leaks, primarily because the tank is fully visible. Further, the tank is less likely to leak in the first instance because it may be maintained with paint and the like.

In the prior art, a single-walled above-ground tank is placed in a "containment" area. Typically, the containment area is a mound of soil, a concrete floor and walls, or other similar type of area which forms a wall (or "berm"). There are, however, a number of problems associated with the use of these above-ground storage systems. Initially the "system" is almost by definition not portable because large volumes of soil must be moved to form the berm, or concrete must be poured to form the berm. Further, in the event of a leak, the material within the tank is widely exposed, creating the likelihood of release of air contaminants and the likelihood of injury to passers-by. They further are not totally impervious to leakage (unless frequently treated with a sealant) due to their porous nature. Another problem with prior systems is that the open and uncovered berms are subject to being filled with rain water and other trash debris. Mixed with product spillage into the secondary containment, this water and debris is considered "contaminated" and must be disposed of accordingly.

It is clear that an improved method and apparatus for the storage of waste oil and other contaminants is needed.

SUMMARY OF THE INVENTION

An above-ground waste oil storage system is described. The system may consist essentially of an outer tank, the outer tank having an open top, the outer tank substantially in the shape of a vertical right cylinder; a substantially closed inner tank, the inner tank substantially in the shape of a vertical right cylinder and placed within the outer tank, the inner tank further comprising a tank oil inlet port, a tank oil discharge port, a vent port, and a level detection port, all of the ports in a top surface of the inner tank, the inner tank and the outer tank forming an annulus between the inner and the outer tanks, the outer tank having a volume of at least about 150% of the inner tank; at least one spacing member on the bottom of the inner tank, the spacing member holding a bottom floor of the inner tank above a bottom floor of the outer tank; at least one spacing member on the bottom of the outer tank, the spacing member holding the outer tank above a resting surface; an air-operated diaphragm pump having a system oil inlet, a pump oil outlet, and a pump air inlet, the oil outlet connected to the tank oil inlet port; a disposal pipe extending upwards from the tank oil discharge port and downwards into the inner tank; a float valve assembly, said float valve assembly comprising: (i) a float in the inner tank, the float having an arm extending through the level detection port; (ii) an air shut-off valve in the pump air inlet, the air shut-off valve positioned in an open position by the arm when the float is not immersed in oil, the valve in a closed position when the float is immersed in oil; and a substantially frustroconical cover over the annulus.

In another embodiment the apparatus comprises a first inner tank; a second outer tank, the inner tank contained within the outer tank, the outer tank having a volume greater than a volume of the inner tank; an air-operated pump having a liquid inlet, a liquid outlet, and an air supply line, the liquid outlet discharging into the inner tank through a tank liquid inlet; and a float valve in the air supply line, the float valve in a closed position when a float connected thereto and contained within the inner tank is in contact with a liquid and the inner tank contains a first volume, and the valve moving to an open position when the tank contains a second volume of liquid, the second volume less than the first volume.

DETAILED DESCRIPTION OF THE PREFERRED EMBODIMENTS

The present invention provides a greatly improved method and apparatus for storing waste oil and other liquids in safe, leak-free, above-ground tanks and is especially suited for storage of waste oil in, for example, a service station. "Other liquids" might include antifreeze, gasoline, solvents, and the like, or any liquid which a user desires not to enter the surrounding environment. The method and apparatus provides an alternative to the more costly underground storage tanks. Above-ground storage does not present the same risk factors normally associated with underground storage tanks in that any leakage will more than likely be discovered before environmental damage occurs.

Figure 1:
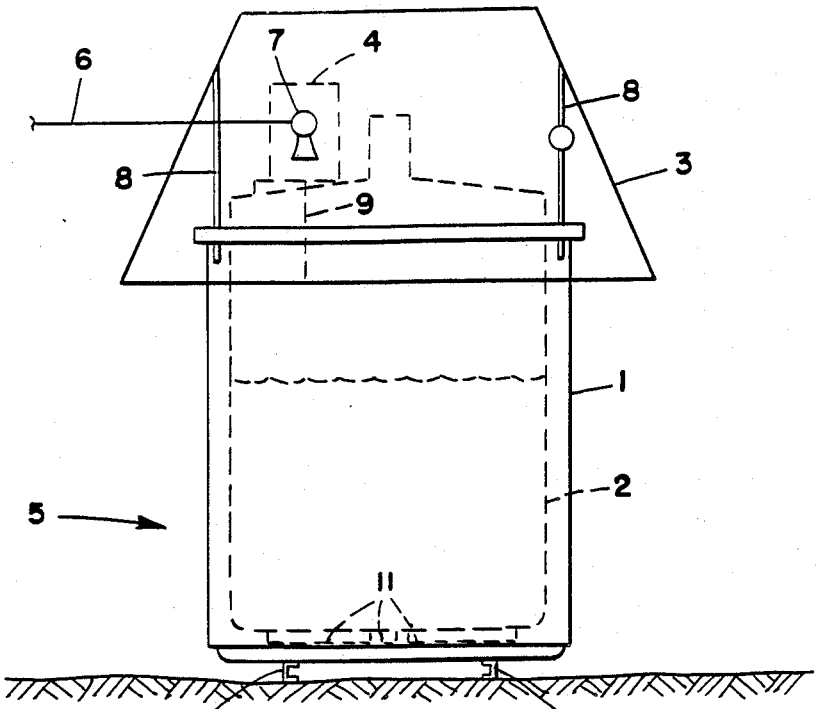
FIG. 1 generally illustrates the above-ground storage system described herein in side view.

Referring to FIG. 1, in its most basic embodiment the invention includes a steel inner tank 2 sitting on end within a separate, open top secondary containment tank 1, both made of steel. A weatherproof lid 3, generally in the shape of a truncated cone, covers at least the annulus formed between the inner and outer tanks and also provides security for the pumping mechanism 4. Lid 3 is preferably attached to the outer containment with brackets 8. The cone-shaped lid 3 serves to prevent the entry of rainwater, debris, and the like. This reduces corrosion of the tanks. Further, if a leak occurs in the inner tank, any material in the annulus would also be considered hazardous. Therefore, lid 3 serves to reduce the volume of waste to be removed.

The purpose of the system 5 is to provide a safe, environmentally sound storage area for holding products such as waste oil, waste anti-freeze, pesticides, waste water, and other products of this nature. The preferred embodiment of the tank uses steel as a construction material, but a wide variety of other materials may be used such as plastic and the like in some embodiments.

As an example of the method of use of the system 5, an automotive service center would drain the waste oil from automobiles (not shown) into a collection caddy (also not shown) which, when filled, would be rolled to the system 5. A hose would be connected to the oil caddy and the waste oil would be sucked into the system from the caddy with pumping mechanism 4. Once the system is filled to capacity, a waste oil tanker would be called in to pump out the system.

All components on the system should be mechanical, requiring no electricity. The secondary containment provides about 150% (+/−10%) of the capacity of the inner tank and will therefore, contain all of the liquid in the inner tank in the event that the inner tank leaks. In a preferred embodiment, the height of the outer tank wall is approximately 95% (+/−5%) of the height of the inner tank. The tanks are built to U.L. #142 specifications, which are incorporated herein by reference for all purposes.

The tank pumping mechanism 4 is self contained and operates on compressed air (provided to the tank by the user). The pumping system 4 comprises a double diaphragm pneumatic pump 7 (a model no. 221–139 manufactured by Graco Corp. in the preferred embodiment) located on the top of the inner storage tank which creates a vacuum which draws the liquid through a ¾" hose 6 and into the tank 2 through pipe 9 (discussed more fully below). The tank is equipped with a site level gauge indicating the level of product remaining in the tank. An automatic overfill safety valve (discussed further below) restricts the flow of air to the pump when the liquid reaches maximum fill capacity. The entire system—tank and containment—is portable and can be moved from one facility to another easily. The outer tank 1 rests on two steel beams 10 enabling a fork lift or pallet jack to raise the unit for transportation.

Figure 2:
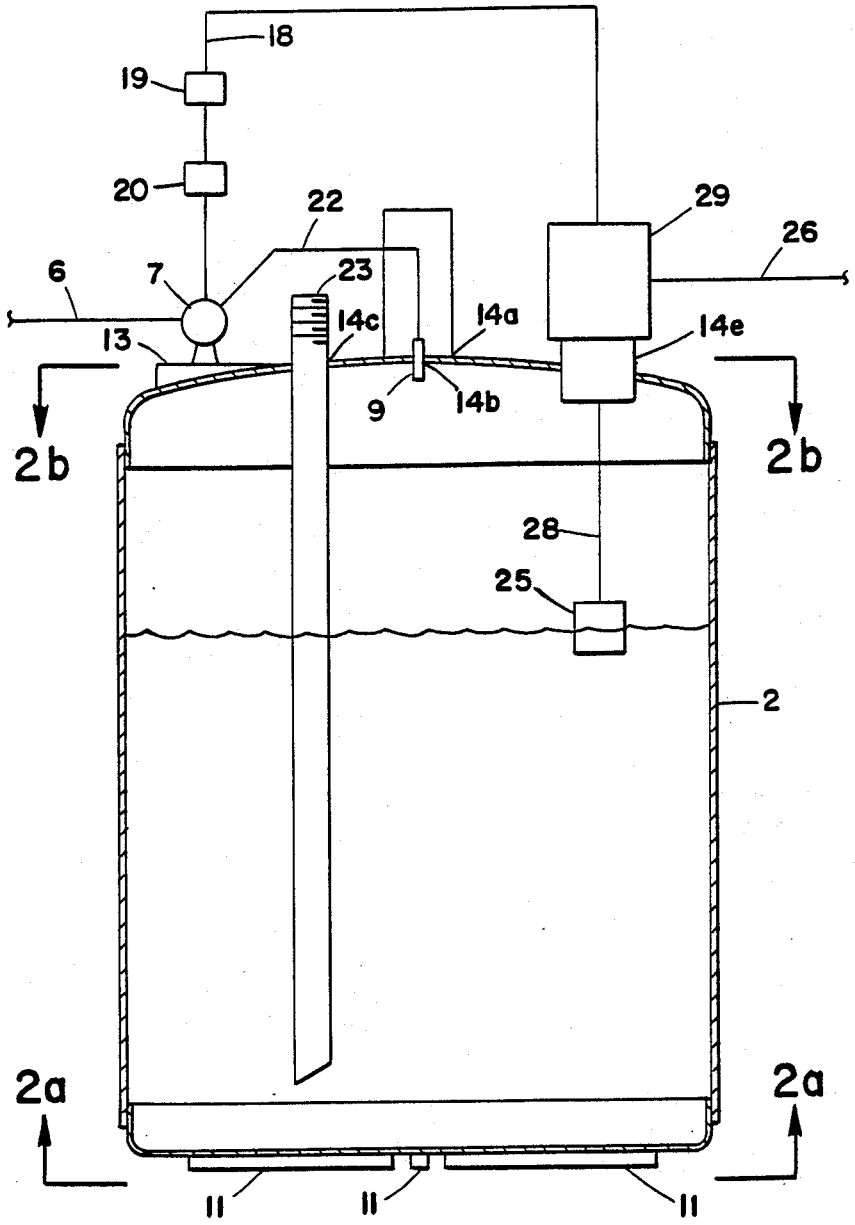
FIG. 2 shows details of the inner tank assembly, in a side view, partially cut-away. It is noted that the pump location has been moved to the left side of the drawing for clarity. The pump is actually located as shown in FIG. 2*b* below.
Figure 2A:
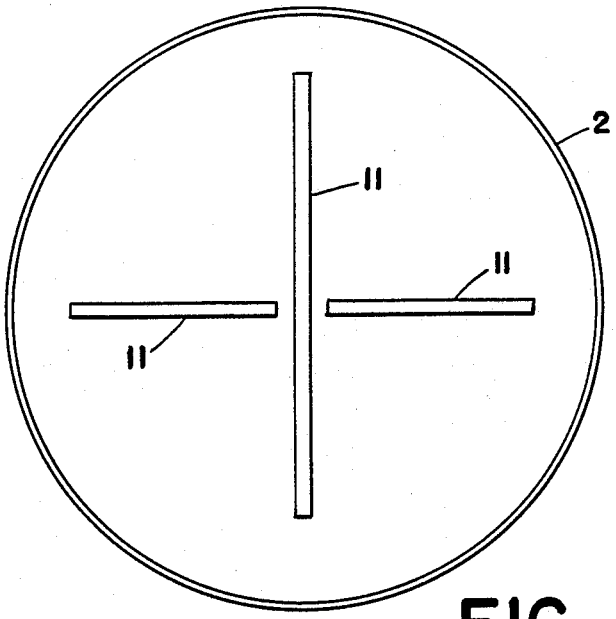
FIG. 2*a* shows the inner tank assembly viewed from below.
Figure 2B:
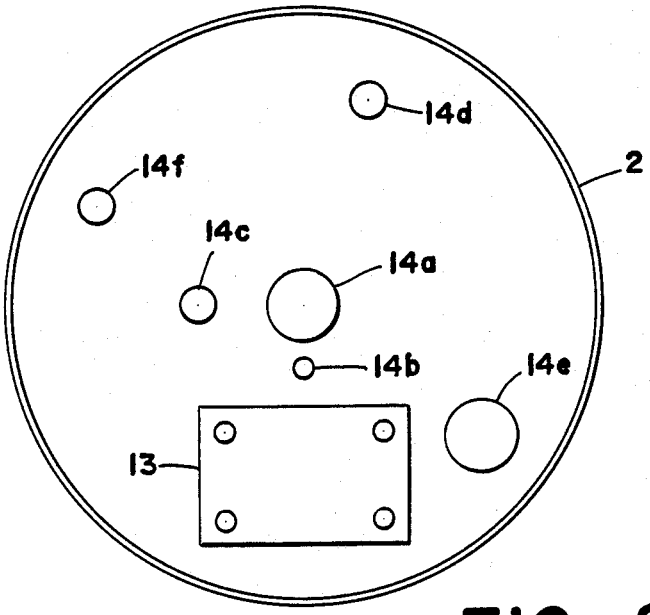
FIG. 2*b* shows the inner tank assembly viewed from above.

More detail regarding the inner tank is shown in FIGS. 2, **2*a*, and 2*b*. The inner tank is fitted with steel rods 11 welded to the bottom of the tank so that when situated on end within the outer containment, the bottom of the tank does not sit directly on the containment. This arrangement permits complete visual inspection of the inner tank for leakage, and prevents moisture that could cause corrosion from being held between the outer and inner tanks. A steel plate 13 is welded to the top of the inner tank so as to provide a platform for the double diaphragm air pump 7 used to transfer oil into the tank from the collection container. All pumping bungs (14*a* to *f***) are built into the top of the tank with no fittings installed on the sides or bottom. As no fittings are installed below the potential product level, it is impossible to have a leak from such fittings (as would generally not be the case with other tanks). The dimensions of the inner tank for two example containment volumes are listed in Table 1 below.

TABLE 1

| | Interior Tank Dimensions | |
|---|---|---|
| | 260-gal. Tank | 550-gal. Tank |
| Diameter | 40 inches | 48 inches |
| Height | 48 inches | 72 inches |
| Capacity | 261 gallons | 564 gallons |
| Wall Construction | 12 ga. steel | 10 ga. steel |

Figure 3:
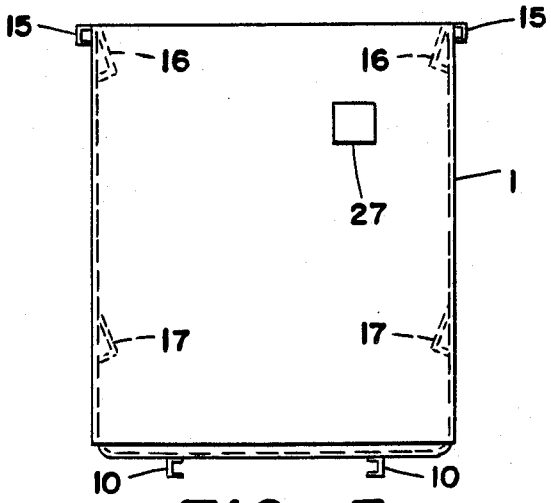
FIG. 3 shows details of the outer tank assembly in side view cross-section.

The outer tank is shown in more detail in FIG. 3, and the dimensions thereof are illustrated in Table 2. The tank is reinforced by a 2"×¾" steel channel band 15 welded around the top of the containment tank 2. The open top tank is supported by two 3" steel channel beams 10 that raise the tank off the ground by 3 inches in order to provide for forklift and/or pallet jack maneuvering. This feature also aids in the reduction of deterioration due to direct contact with damp ground surfaces. The containment is equipped with three inner stays 16 welded to the inside of the containment near the top rim of the tank and another three stays 17 welded near the bottom. The stays act as guides when lowering the inner tank into the outer containment and provide a secure structure to wedge the inner and outer tanks during shipping. In addition, they provide lifting hook points for the unit when a "boom" type lift is desired. A rectangular box 27 is welded to the outside of the outer containment at approximately 45° to the right of front center. This box provides a housing for a site level gauge, which is attached to the inner tank through bung **14*f***. The containment is primer-coated and painted with a final coat of rust-resistant enamel.

TABLE 2

| | Exterior Tank Dimensions | |
|---|---|---|
| | 260-gal. Inner Tank | 550-gal. Inner Tank |
| Diameter | 47 inches | 57 inches |
| Height | 48 inches | 72 inches |
| Capacity | 360 gallons | 795 gallons |
| Wall Construction | 14 ga. steel | 12 ga. steel |

Referring again to FIG. 2, the system is equipped with a double diaphragm U.L. listed air operated pump 7. The pump is bolted to a steel plate 13 that is welded directly onto the top of the inner holding tank. The pump is used to transfer product from a collection container (of the users choice) into the system. A Graco Model 221–139 is used in the preferred embodiment. The pump is modified so that the intake manifold is reversed so that the manifold plumbing faces in a direction reversed from its normal direction. Therefore, the intake suction hose extends outward and away from the center of the tank while the exhaust discharge faces tank center and is plumbed into the tank through a one-inch rubber hose 22 and bung **14*b***. The rubber hose absorbs vibration and shock that could occur during pumping, therefore preventing stress cracking of the tank and plumbing.

To filter the air coming into the pump assembly 7 from air supply line 18, an air filter 19 is provided. In the preferred embodiment, the filter assembly includes an Amflow 2000 filter. The air filter is attached to an air regulator 20. In a preferred embodiment the regulator is an Amflow 2100 with an Amflow 2160 Regulator Bracket and is plumbed into the pump 7 through a ¼"×3" galvanized pipe nipple, a ¼" 90° galvanized nipple, and a ¼" 4" galvanized pipe nipple. The entire assembly is bolted to a bracket (not shown).

The pump inlet piping 6 in the preferred embodiment is a 12'×¾" hose with female dry-break quick coupler connector attached to one end while the other end is plumbed to the intake side of the air pump assembly. The hose could be, for example, a Royal Brass No. ASM P12C30101-12-16-12ft and the coupler could be a Parker H6-62.

To empty the tank, a 2" galvanized pipe 23 extends through the top of the inner tank to the bottom through bung 14c. This "stinger" is cut at approximately a 45° angle on its bottom end to prevent sedimentation buildup in the tank. The top of the discharge pipe is equipped with a 45° and 90° street ell (not shown), and fitted with an OPW 633A 2" aluminum coupler with OPW 634B cover. This unit screws onto the tank discharge pipe to provide a drip-free hook-up to the waste oil truck. The collection truck simply pumps the product out of the tank and into the tanker as would be the case with an underground tank.

Bungs **14*a* and 14*d* provide venting for the tank. Bung 14*a* is generally capped with a loosely-fitted metal cap or the like and acts as an emergency pressure relief valve/explosion relief valve. Valve 14*d* is not capped and acts as a vent for normal filling and discharging of the tank. Vent 14*d*** may optionally be connected to a vapor recovery unit for air pollution control reasons, or plumbed outside the cover.

Each tank is equipped with, for example, a KRUEGER Remote Level Gauge which is mounted on the inner tank at bung **14*f* and run over the top of the tank to protective box 27** approximately 45° right of center that is fitted on the outer tank. As the tank fills, the gauge turns red, proportionate to the level of the product within the tank.

Figure 4:
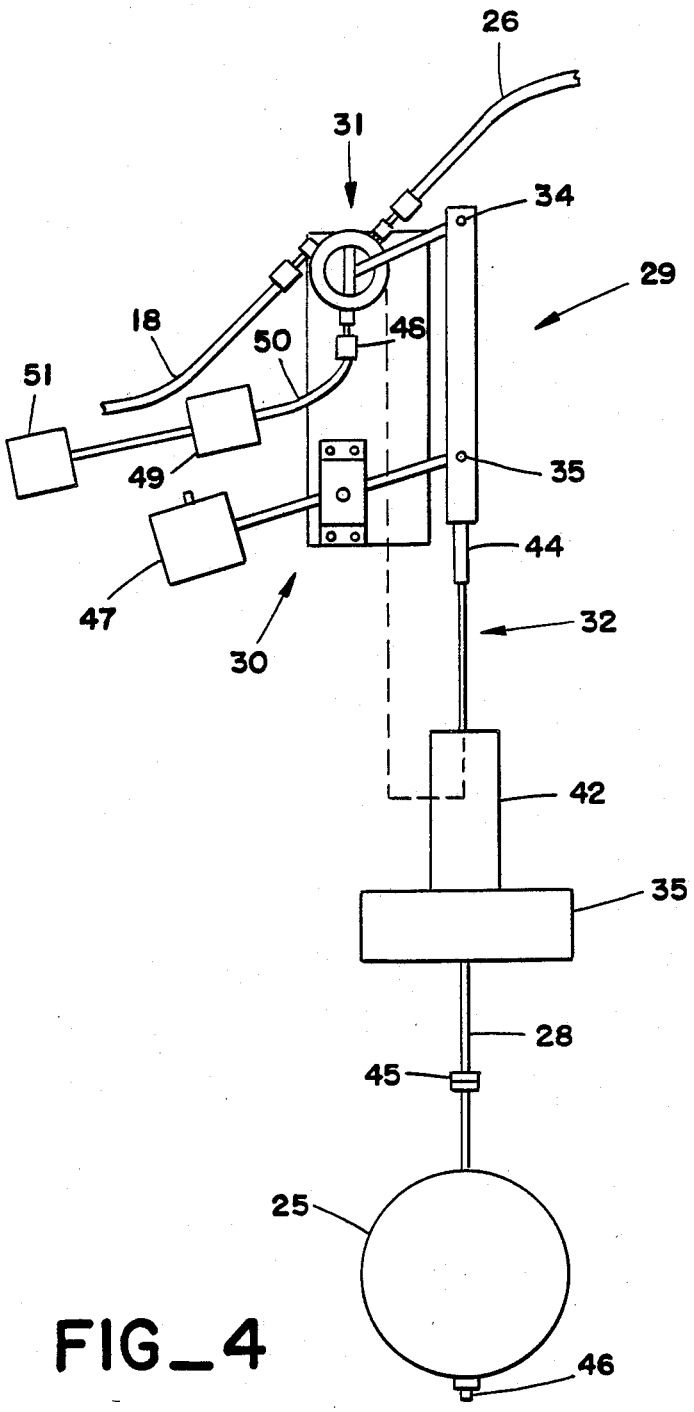
FIG. 4 illustrates the overfill valve assembly.

FIG. 4 shows details of the overfill valve assembly 24. The valve assembly provides a means of shutting off the air supply 18 to the intake pump 7 when the tank approaches fill capacity. This prevents over-filling even when the user is not conscious of the fact that the tank is nearing capacity. The valve may further include a means of providing a warning signal either by closing a mechanical switch or sounding an air-operated warning device such as a bell. The valve assembly preferably includes a Cla-Val CF-1-C1 valve 29 which is modified by reversing the direction of the plunger mechanism and turning the supplied mounting plate 30 over so that the unit may be bolted to bracket 32 in a direction opposite that from its normal installation. The standard brass fittings are removed and the valve is fitted with ⅛"×90° male EL's. The overfill valve bracket is welded to a 1"×3" galvanized nipple 42 threaded on one side only, and the galvanized nipple screws into a galvanized 1"×4" reducing bushing 35. The bracket is further attached to the valve assembly with two 1"×5/16" bolts and nuts with a star washer on each. An 18"×⅜"×"machine" 'all-thread' is screwed into the CF-1-C1 float mechanism, onto which a 4" copper float 25 with a ½" hole through the middle is placed. The arm and ball float are stayed with ⅜" washers and jam nuts 44. A 24" and 16" air hose (18 and 26) (Royal Brass No. ASM RAH0102-4-2-4-24.00 and ASM RAH0102-4-2-4-16) are installed onto valve #1 and #2 of the CF-1.

The finished assembly is screwed into a 4" bung **14*e* provided on the top of the inner tank and then plumbed between the primary air supply 26 and the pump assembly 7 through air line 18**.

The overfill valve works as follows. Weight 47 is adjusted so that it is in balance with arm 28. Therefore, arm 28 will retain its "last" position due to friction in the system. Float 25 is slidably mounted on arm 28 between bolts 45 and 46. As liquid rises in the tank, float 25 is lifted until contacting bolt 45, thereby lifting arm 28. Arm 28 is connected to a rotating disc assembly 31. When the arm is in the "down" position the holes in a first disc are aligned with holes in a similar second disc which is closely mated thereto, allowing the passage of air. As the arm is lifted by the float, the first disc is rotated such that the holes are no longer aligned with those in the second disc, blocking the flow of air to the pump and redirecting it to discharge line 48 thereby preventing the user from further filling the tank. The faces of the opposing discs are machined to fit very tightly, providing a tight seal. The system avoids the use of, for example, rubber seals which may fail and permit overflow of the tank.

Conversely, when emptying the tank, the arm does not move until the float contacts the lower restraining nut 46. Therefore, it is necessary to remove a substantial amount of liquid before activating the air pump. This helps to prevent an operator from removing a small amount of oil (and, perhaps, disposing of the small volume improperly).

Referring again to FIG. 1, the environmental cover 3 provides functional security for the pump and valve assemblies. It serves as rain and weather protection, and prevents debris from falling into the secondary containment through the annulus between the inner and outer tanks. The cover design permits the installation of fire suppressive devices (such as a halon sprinkler device) within it—providing additional safety to the overall storage system. In addition to these benefits, the cover adds aesthetic value to the structure.

The cover is constructed of 20 ga. galvanized sheet metal riveted to a mild steel frame structure. The dimensions of the top for the 260 gal. inner tank embodiment are 60" diameter at the bottom; 35" diameter at the top; 22" in height. The cover is hinged to the outer containment with two brackets 8 and can be locked down to a small metal stay (not shown) that is welded to the outer containment of the tank. The cover is made as a separate component and shipped separately from the tanks to help reduce damage.

It is necessary for a user of the system to provide a source of air 26 (minimum of 80 lbs. pressure) and to install an on/off valve for the air source. When transferring product into the tank, a suction hose (female end of a quick-connect dry-break) is coupled to the transfer container (male end of the quick-connect dry-break) and the air source is turned on. Once the transfer container is emptied, the air source is turned off and the hose disconnected at the quick-connect dry-break. The visual level gauge 27 indicates the remaining fill capacity of the container. The overfill safety valve restricts the flow of air to the pump when the level reaches maximum fill potential.

In order to provide even greater environmental security to the system (and again referring to FIG. 4), vent line 48 may further be connected to an air line 50, which is further connected to an air switch 49. Air switch 49 could in turn activate an automatic telephone dialer of the type commonly used in security alarms. Dialer 51 could be programmed to contact the facility owner, an environmental agency, a disposal company, or other desired location. This could provide a record of the tank having reached capacity and would act as a significant disincentive to illicit dumping of the material contained within the tank.

It is to be understood that the above description is intended to be illustrative and not restrictive. The scope of the invention should, therefore, be considered not with reference to the above description, but instead with reference to the appended claims, along with the full scope of equivalents to which they are entitled.

What is claimed is:

1. An above-ground waste oil storage system comprising:

(a) an outer tank, said outer tank having an open top;

(b) a substantially closed inner tank, said inner tank placed within said outer tank, said inner tank further comprising a tank oil inlet port, a tank oil discharge port, a vent port, and a level detection port, all of said ports in a top surface of said inner tank, said inner tank and said outer tank forming an annulus between said inner and said outer tanks;

(c) an air-operated diaphragm pump having a system oil inlet, a pump oil outlet, and a pump air inlet, said oil outlet connected to said tank oil inlet port;

(d) a disposal pipe extending upwards from said tank oil discharge port and downwards into said inner tank;

(e) a float valve assembly, said float valve assembly comprising:

(i) a float in said inner tank, said float having an arm extending through said level detection port; and (ii) an air shut-off valve in said pump air inlet, said air shut-off valve positioned in an open position by said arm when said float is not immersed in oil, said valve in a closed position when said float is immersed in oil; and (f) a substantially frustroconical cover over said annulus.

2. Apparatus for preventing entry of a liquid into the environment comprising:

(a) a first inner tank;

(b) a second outer tank, said inner tank contained within said outer tank, said outer tank having a volume greater than a volume of said inner tank, said inner tank and said outer tank forming an annulus therebetween;

(c) an air-operated pump having a liquid inlet, a liquid outlet, and an air supply line, said liquid outlet discharging into said inner tank through a tank liquid inlet;

(d) a float valve in said air supply line, said float valve in a closed position when a float connected thereto and contained within said inner tank is in contact with a liquid and said inner tank contains a first volume, and said valve moving to an open position when said tank contains a second volume of liquid, said second volume less than said first volume;

(e) a float arm, said float arm connecting said float to said float valve in said supply line, said arm extending into said tank through a float arm aperture; and (f) an inner tank discharge aperture, said float arm aperture, said inner tank liquid inlet, and said discharge aperture on said inner tank above said float.

3. Apparatus for preventing entry of a liquid into the environment comprising:

(a) a first inner tank;

(b) a second outer tank, said inner tank contained within said outer tank, said outer tank having a volume greater than a volume of said inner tank, said inner and said outer tank forming an annulus therebetween;

(c) an air-operated pump having a liquid inlet, a liquid outlet, and an air supply line, said liquid outlet discharging into said inner tank through a tank liquid inlet;

(d) a float valve in said air supply line, said float valve in a closed position when a float connected thereto and contained within said inner tank is in contact with a liquid and said inner tank contains a first volume, and said valve moving to an open position when said tank contains a second volume of liquid, said second volume less than said first volume; and (e) said float valve further comprising a first and a second disc, said first and said second disc containing at least a first and a second aperture, respectively, said first and said second disc rotatable from a first position in which said first aperture is in alignment with said second aperture and permits air to flow to said pump, to a second position in which said first and said second aperture are not in alignment and do not permit air to flow to said pump, said discs rotated by said float and in said first position when said float is not in contact with a liquid and in said second position when said float is in contact with a liquid.

4. Apparatus as recited in claim 3, further comprising:

(a) an air vent line, said air vent line receiving a flow of air when said second disc is in said second position;

(b) an air switch connected to said air vent line; and (c) a telephone dialer activated by said air switch.

5. Apparatus for preventing entry of a liquid into the environment comprising:

(a) a first inner tank;

(b) a second outer tank, said inner tank contained within said outer tank, said outer tank having a volume greater than a volume of said inner tank, said inner and said outer tank forming an annulus therebetween;

(c) an air-operated pump having a liquid inlet, a liquid outlet, and an air supply line, said liquid outlet discharging into said inner tank through a tank liquid inlet;

(d) a float valve in said air supply line, said float valve in a closed position when a float connected thereto and contained within said inner tank is in contact with a liquid and said inner tank contains a first volume, and said valve moving to an open position when said tank contains a second volume of liquid, said second volume less than said first volume; and (e) a cover, said cover mounted to said outer tank and substantially in the shape of a truncated cone, said cover covering at least said annulus.

6. Apparatus as recited in claims 2, 3 or 5, further comprising means for flowing waste oil into said liquid inlet.

7. Apparatus as recited in claims 2, 3 or 5, wherein said outer tank has a volume of about 150% of said inner tank.

8. Apparatus as recited in claims 2, 3 or 5, wherein said pump is a diaphragm pump.

9. Apparatus as recited in claims 2, 3 or 5, further comprising means for carrying said outer tank with a forklift.

10. Apparatus as recited in claims 2, 3 or 5, further comprising support members between a bottom floor of said inner tank and a bottom floor of said outer tank.

* * * * *